United States Patent [19]

Williams

[11] 4,382,514

[45] May 10, 1983

[54] DISPENSER CARTON

[75] Inventor: Donald L. Williams, Morris, Ill.

[73] Assignee: Champion International Corporation, Stamford, Conn.

[21] Appl. No.: 259,504

[22] Filed: May 1, 1981

[51] Int. Cl.[3] ..... B65D 5/08; B65D 5/54

[52] U.S. Cl. ..... 206/626; 229/17 B

[58] Field of Search ..... 206/626; 229/17 R, 17 B

[56] References Cited

U.S. PATENT DOCUMENTS

| | | | |
|---|---|---|---|
| 1,847,028 | 2/1932 | Townsend | 229/17 R |
| 2,064,029 | 12/1936 | Murray | 206/626 |
| 2,205,068 | 6/1940 | Potter | 229/17 R |
| 2,233,488 | 3/1941 | Powell | 229/17 R |
| 2,847,153 | 8/1958 | Guyer et al. | 229/17 B |
| 2,909,310 | 10/1959 | Govang | 229/17 B |
| 3,153,504 | 10/1964 | Mischel et al. | 229/17 R |
| 3,185,374 | 5/1965 | Feeney | 229/17 R |
| 3,421,680 | 1/1969 | Cohee | 229/17 R |

*Primary Examiner*—Stephen P. Garbe

*Attorney, Agent, or Firm*—Evelyn M. Sommer; William W. Jones

[57] ABSTRACT

A one-piece fiberboard carton having an integral dispensing flap. A tear strip is drawn along an edge of the dispenser flap which is formed intermediate the top and bottom edges of the front surface of the carton so that the flap may be pulled out of the plane of the front of the carton and disposed at an angle with respect to the carton so that when the carton is placed on a side, product stored within the carton can be dispensed by gravity feeding it through the opening adjacent the dispenser flap. Alternatively, the dispenser flap may be taped by adhering a tab to the front wall of the carton which may be cut along a line to open the same. Oppositely disposed web corners attach the dispenser flap at an acute angle to the front wall of the carton so that when it is opened, the product will not fall from the carton unless the carton is intentionally placed on its side in a dispensing position. By use of the web-connecting flaps, the dispenser flap may be opened and closed, as needed, to open and close the carton before all the product is dispensed, to dispense and store any remaining product.

3 Claims, 10 Drawing Figures

Fig. 1.
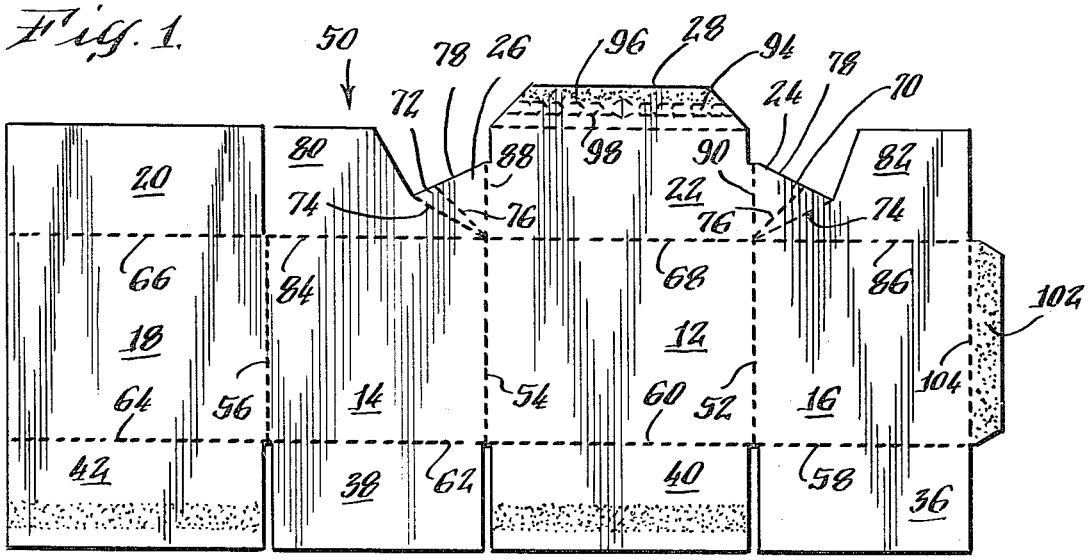
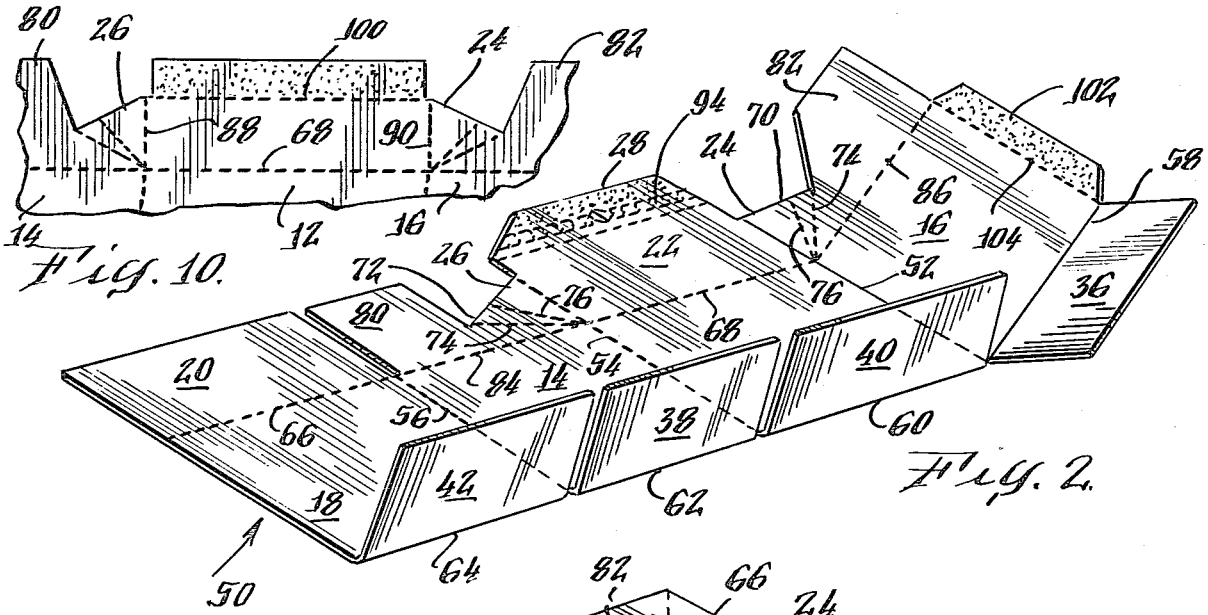
Fig. 10.
Fig. 2.
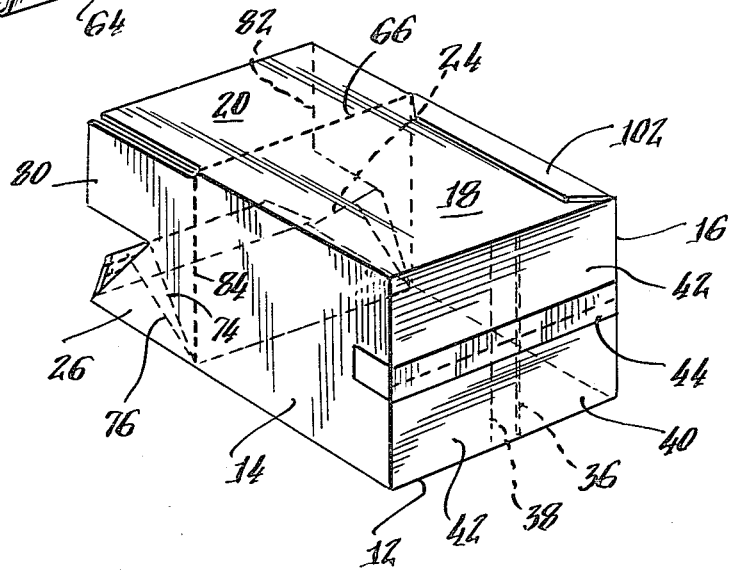
Fig. 3.

DISPENSER CARTON

BACKGROUND AND SUMMARY OF THE INVENTION

This invention relates to a carton formed from a one-piece, unitary blank and more particularly, a fiberboard carton of the type having an integral dispensing flap which may be opened and reclosed to dispense product stored within the carton.

Many times, it is necessary to have a convenient receptable to store articles prior to their use or assembly into a finished product. The container of the present invention can be used to ship such articles and is ideally suited to store the articles prior to their use.

The container of the present invention is die-cut and manufactured on conventional machinery. The container utilizes the same amount of material as a regular slotted container and may be taped, glued or stitched to erect the same without any special material.

The container is formed from a one-piece, die-cut blank which when folded and taped closed, forms a carton with an integral dispensing flap which may be opened and reclosed as many times as needed to dispense the product from the interior of the container.

A tear strip is drawn along an edge of the dispenser flap which is formed intermediate the top and bottom edges of the front of the carton so that the flap may be pulled out of the plane of the carton front wall and disposed at an angle with respect to the carton so that when the carton is placed on a side, product stored within the carton can be dispensed by gravity feeding it through the opening left by the dispenser flap.

Alternatively, the dispenser flap may be taped by adhering a tab to the front wall of the carton. The tab may be cut along a line to open the flap. Oppositely disposed web corners attach the dispenser flap at an acute angle to the front wall of the carton so that when it is opened, the product will not fall from the carton unless the carton is intentionally placed on its side in a dispensing position. By use of the web-connecting flaps, the dispenser flap may be opened and closed, as needed, to open and close the carton before all the product is dispensed, to dispense and/or store any remaining product.

BRIEF DESCRIPTION OF THE DRAWINGS

Further objects and advantages of the invention will become apparent from the following description and claims, and from the accompanying drawings, wherein:

FIG. 1 is a plan view of a blank used to form the carton of the present invention;

FIGS. 2 to 5 are perspective views of the blank of FIG. 1 being folded into the carton of the present invention;

FIG. 10 is a perspective view of an alternative embodiment of the carton of the present invention having a flange adapted to be cut to open the carton.

DETAILED DESCRIPTION OF THE PREFERRED EMBODIMENT

Figure 6:
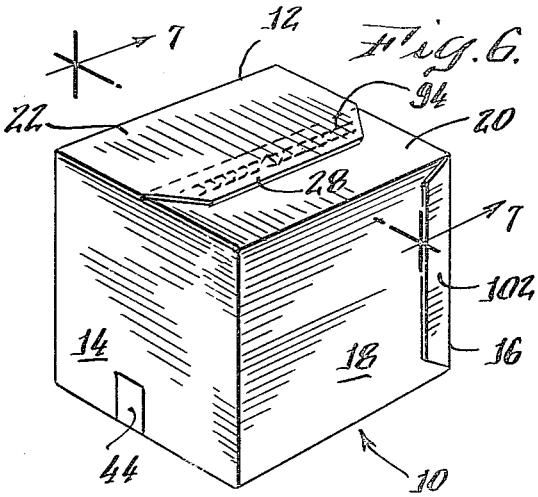
FIG. 6 is a perspective view of the carton of the present invention.
Figure 8:
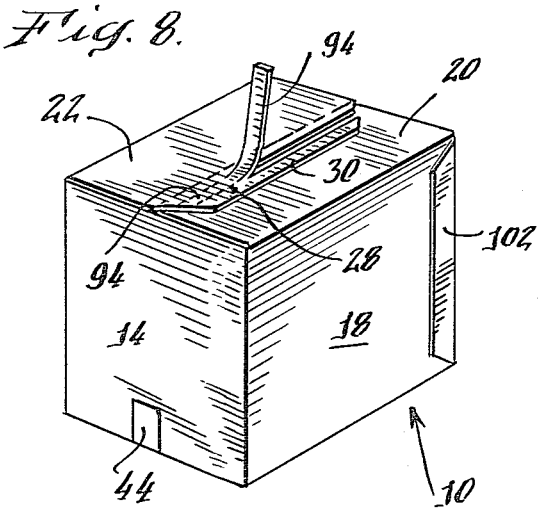
FIG. 8 is a perspective view illustrating the manner of opening the carton of FIG. 6.

Referring now to the drawings in detail, wherein like numerals indicate like elements throughout the several views, the dispenser carton of the present invention is illustrated in FIG. 6 and generally designated by the numeral 10.

The carton 10 includes a bottom panel 12 foldably connected to opposed side panels 14 and 16. Panel 14 is foldably connected to a top panel 18. The front surface 20 of container 10 includes an integral dispensing flap 22 connected to the front surface by an opposed pair of web corners 24 and 26 adapted to be folded back upon themselves into the plane of the front surface as will be made more apparent in the description following hereinafter.

The dispenser flap 22 is held in the plane of the front surface 20 of carton 10 by a tear strip or severable flap 28 adhered to the front surface of the carton by an adhesive strip 30. When flap 28 is torn or severed along either a tear strip or severance line, dispenser flap 22 can be moved outwardly from the plane of the front surface 20 of carton 10 and be disposed at an upright acute angle with respect thereto, as illustrated, for example, in FIG. 9. The carton 10 may then be turned to dispense articles from the interior thereof or articles may be grasped from the interior and removed through the dispensing opening 32.

By virtue of the fact that the dispenser flap 22 is disposed at an acute angle with respect to the front surface 20, articles cannot be removed indiscriminately from the interior of the carton. Rather, the carton must be rotated (see FIG. 9) so that the contents can be gravity fed through the dispensing opening 32 and slid over the dispenser flap 22. The rear surface 34 of carton 10 is formed from two pairs of interior flaps 36 and 38 overlapped and abutted by flaps 40 and 42 which are taped along a common line of abutment by adhesive tape 44.

Figure 9:
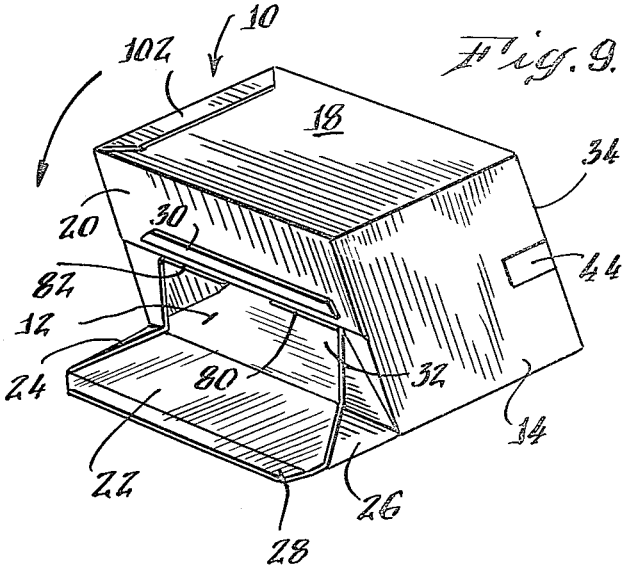
FIG. 9 is a perspective view illustrating the opening and use of the dispensing flap of the carton of FIG. 6 to dispense product from the interior of the carton.

In use, the container is filled either from the rear or front surfaces, the corresponding flaps folded in, and taped. When in use, the connecting flap 28 is severed from the lower dispensing flap 22, the dispensing flap opened, and product gravity fed through the dispensing opening 32 by rotation of the container, as indicated in FIG. 9. The dispenser flap 22 may be opened and closed as needed unitl all the product within the container is used. When the dispensing flap 22 is reclosed, the container can be used to store the product for subsequent use.

As indicated in FIG. 1, the container 10 is formed from a one-piece, unitary fiberboard blank 50.

The blank 50 includes rectangular or square side panels 14 and 16 foldably connected along score lines 52 and 54, respectively, to bottom panel 12. A rectangular panel 18 is foldably connected by a score line 56 to an edge of side panel 14. Spaced, rectangular rear surface-forming flaps 36, 40, 38 and 42 are respectively connected by score or fold lines 58, 60, 62 and 64 to side panel 16, bottom panel 12, side panel 14, and top panel 18.

The upper portion of the front surface of carton 10 is formed by a substantially rectangular front surface panel 20 foldably connected by a score line 66 to the opposite edge of top panel 18. The dispenser flap 22 is formed from a substantially rectangular panel 22 foldably connected by a score line 68 to the free edge of the bottom panel 12. Web corners 24 and 26 are formed by triangular panels 70 and 72, respectively, formed by spaced slit-score lines 74 and 76 extending from an interior corner of panel 22 to the outer edge 78 of an adjacent panel 80 and 82, respectively, connected by score lines 84 and 86 to the free edge of adjacent side panels 14 and 16, respectively. As illustrated in FIG. 1, the corner panels are formed by die-cutting the edge 78 inwardly at an angle to a score line 88 and 90, respectively, connecting each of the panels 70, 72 to the opposed edges of dispenser flap panel 22.

Connector flap 28 is connected to one of the longitudinal edges of dispenser flap 22 by a tear strip 94 defined by a pair of parallel lines of weakness 96 and 98 extending along the length of the juncture of the flaps 22 and 28. In lieu of tear strip 94, a single, perforated cut line 100 may be provided at the juncture between panels 28 and 22. A glue panel 102 is connected to one of the horizontal edges of side flap 16 by a score line 104 to complete the blank construction.

Figure 4:
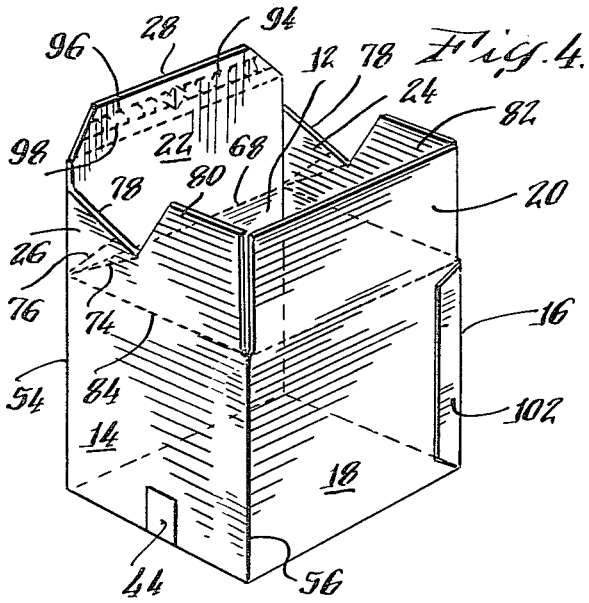

In forming carton 10, as indicated in FIGS. 2 to 5, the panels are first rotated 90° about their respective edge score lines to form a substantially rectangular parallelopiped structure as illustrated in FIGS. 3 and 4. Glue flap 102 is adhered to an exterior surface of top panel 18 and the rear panels 36 and 38 folded adjacent each other, as well as the panel pairs 40, 42. The rear panels can then be taped with a tape 44 along the abutting line of panels 40 and 42 to seal the rear surface.

Figure 5:
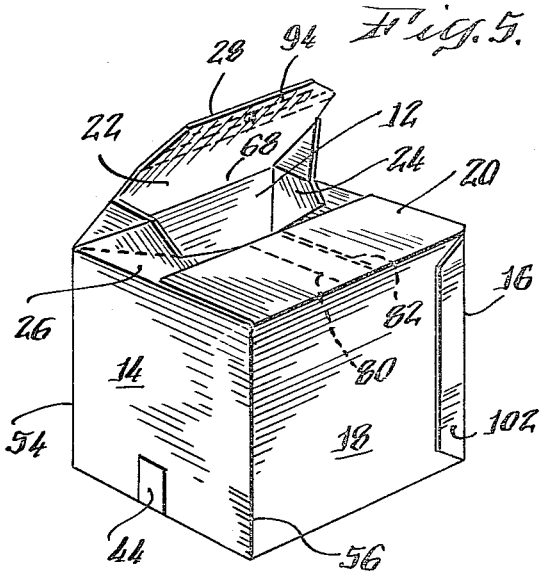
Figure 7:
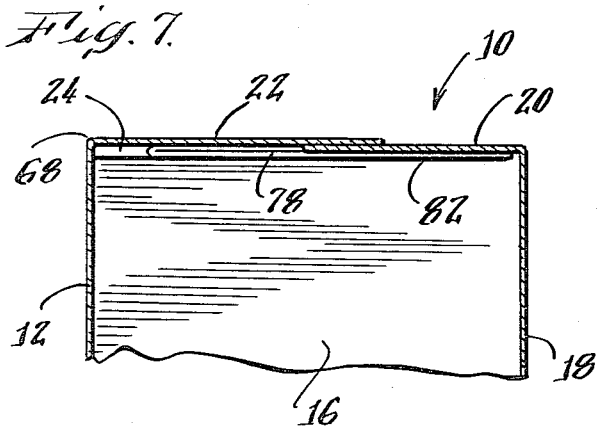
FIG. 7 is a cross-sectional view taken substantially along the plane indicated by line 7—7 of FIG. 6.

Web corner panels 24 and 26 are then folded inwardly about themselves about slit-score lines 76. The panel portions on opposite sides of the central slit score line 76 will be folded into abutting relationship as each of the panels folds about score 74 and score lines 88 and 90 attaching each of the opposed corners to opposite edges of the dispenser flap panel 22. Connector flap 28 will then overlie and abut descending front panel 20 and can be taped thereto by strip 30, as indicated in FIGS. 5 to 7.

In order to open carton 10, it is only necessary to dissociate connector flap 28 from dispenser flap 22 by cutting along line 100 or removing the tear strip 94 disposed between the panels. Dispenser panel 22 can then be rotated downwardly away from front panel 20, web corner flaps 70, 72 unfolded so that the dispenser flap 22 can be disposed at an acute angle with respect to the plane of the front panel 20 as indicated in FIG. 9. Carton 10 can then be rotated to dispense the contents through the dispenser opening 30. In order to reseal the carton, it is only necessary to refold the web corners about central slit-score line 76 to bring the dispenser flap 22 back into the plane of the front panel 20. In this position, articles can be retained and stored within the interior of carton 10.

What is claimed as new is:

1. A dispensing carton comprising:

(a) a pair of opposed top and bottom panels;

(b) a pair of side panels extending between side edges of said top and bottom panels;

(c) a plurality of flaps foldably connected to back edges of said top, bottom and side panels, said flaps being overlapped and secured together to form a back closure for said carton;

(d) a front panel foldably connected to a front edge of said top panel and disposed perpendicular to said top panel, said front panel having a bottom free edge spaced apart from said bottom panel to provide a dispensing opening for said carton;

(e) a pair of opposed panels foldably connected to front edges of said side panels and disposed perpendicular to said side panels, said opposed panels and said front panel overlapping each other and being secured together to form a portion of a front closure for said carton;

(f) a dispenser flap foldably connected to a front edge of said bottom panel, said dispenser flap being disposed perpendicular to said bottom panel and spanning said dispensing opening to close the latter;

(g) releasable means securing said dispenser flap to said front panel; and (h) a pair of web panels, each of said web panels being foldably connected to a side edge of said dispenser flap and foldably connected to an edge of each of said opposed panels, along a skew fold line disposed at an acute angle with respect to the adjacent one of said front edges of said side panels, each of said web panels being traversed by a medial fold line extending to a free edge of each of said web panels whereby said web panels can be folded back upon themselves and tucked beneath said dispenser flap when the carton is closed, and said web panels further being operable, by reason of the acute angle relationship between said skew fold lines and said front edges of said side panels, to hold said dispenser flap at an acute angle with respect to said front panel when said dispenser flap is pivoted about its fold connection with said bottom panel to open said carton.

2. A paperboard blank for forming a dispensing carton, said blank comprising:

(a) top, bottom and side panels serially disposed and connected together by intervening parallel fold lines;

(b) a plurality of back closure flaps foldably connected to back edges of said top, bottom and side panels along colinear fold lines;

(c) a front closure panel foldably connected to a front edge of said top panel;

(d) a dispenser flap foldably connected to a front edge of said bottom panel;

(e) a first panel foldably connected to a front edge of one of said side panels;

(f) a second panel foldably connected to a front edge of the other of said side panels;

(g) the fold lines connecting said front, dispenser flap and said first and second panels to the respective top, bottom and side panels being colinear;

(h) a first web panel foldably connected to an edge of said first panel along a skew fold line disposed at an acute angle with respect to said front edge of said one of said side panels and foldably connected to a side edge of said dispenser flap;

(i) a second web panel foldably connected to an edge of said second panel along a skew fold line disposed at an acute angle with respect to said front edge of the other of said side panels and foldably connected to a side edge of said dispenser flap; and (j) said first and second web panels each being traversed by a medial fold line which extends to a free edge of each of said web panels.

3. The blank of claim 2, further comprising a connector flap rupturably connected to said dispenser flap.

* * * * *